US008186794B2

(12) United States Patent
Cho

(10) Patent No.: US 8,186,794 B2
(45) Date of Patent: May 29, 2012

(54) METHOD OF CORRECTING ALIGNMENT ERROR OF ARRAY INKJET HEAD

(75) Inventor: Seo-hyun Cho, Seongnam-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 501 days.

(21) Appl. No.: 12/550,556

(22) Filed: Aug. 31, 2009

(65) Prior Publication Data

US 2010/0171781 A1 Jul. 8, 2010

(30) Foreign Application Priority Data

Jan. 8, 2009 (KR) ..... 2009-1600

(51) Int. Cl.
*B41J 29/38* (2006.01)

(52) U.S. Cl. ..... 347/14

(58) Field of Classification Search ..... 347/14
See application file for complete search history.

(56) References Cited

U.S. PATENT DOCUMENTS

2008/0297555 A1* 12/2008 Cho et al. ..... 347/19

* cited by examiner

*Primary Examiner* — Uyen Chau N Le
*Assistant Examiner* — Hoang Tran
(74) *Attorney, Agent, or Firm* — Stanzione & Kim, LLP

(57) ABSTRACT

A system and method of correcting an alignment error of an array inkjet head having a plurality of head chips to print a main scanning line can include determining a reference head chip, printing a plurality of reference lines in the main scanning direction to be separated from one another at a reference interval in a sub-scanning direction using the reference head chip, and printing a plurality of test lines which can be offset by a multiple m, where m is an integer, of a test interval with respect to the reference interval using other head chips, and determining one of the plurality of test lines that matches any of the plurality of reference lines of each of the head chips, and determining an amount of offset of the determined test line as an amount of offset of each head chip.

13 Claims, 3 Drawing Sheets

METHOD OF CORRECTING ALIGNMENT ERROR OF ARRAY INKJET HEAD

CROSS-REFERENCE TO RELATED APPLICATIONS

This application claims the benefit of Korean Patent Application No. 10-2009-0001600, filed on Jan. 8, 2009, in the Korean Intellectual Property Office, the disclosure of which is incorporated herein in its entirety by reference.

BACKGROUND

1. Field of the Invention

The present general inventive concept relates to a system and method of correcting an alignment error of an array inkjet printhead having a plurality of head chips, and more particularly to a method of correcting an alignment error in a sub-scanning direction.

2. Description of the Related Art

In general, inkjet image forming apparatuses form an image on paper transferred in a sub-scanning direction by ejecting ink from a shuttle type inkjet printhead that reciprocates in a main scanning direction. The inkjet printhead typically includes at least one inkjet head chip that includes a plurality of nozzles for ejecting ink and an ejection unit providing an ink ejection pressure.

Recently, an effort to enable fast printing by using an array inkjet printhead including a nozzle unit having a length in the main scanning direction corresponding to the width of paper, instead of the shuttle type inkjet printhead, has been made. However, the nozzle unit of the array inkjet printhead is difficult to be embodied in a single head chip. In general, the nozzle unit is embodied by arranging a plurality of head chips, each having a plurality of nozzles, in the main scanning direction. To obtain superior print quality, the head chips must be accurately aligned in the sub-scanning direction. Accordingly, when an offset in the sub-scanning direction is generated during the alignment of the head chips, the offset is directly reflected in a printed image. However, it is very difficult to arrange the head chips without an offset in the sub-scanning direction. Accordingly, the manufacturing costs rise to obtain accuracy in the alignment in the sub-scanning direction in a manufacturing process.

SUMMARY

Example embodiments of the present general inventive concept provide a method of correcting an error in a sub-scanning direction of head chips of an array inkjet printhead.

Additional embodiments of the present general inventive concept will be set forth in part in the description which follows and, in part, will be obvious from the description, or may be learned by practice of the general inventive concept.

Example embodiments of the present general inventive concept provide a method of correcting an alignment error of an array inkjet head having a plurality of head chips to print a main scanning line, including determining a reference head chip, printing a plurality of reference lines in the main scanning direction to be separated from one another at a reference interval in a sub-scanning direction using the reference head chip, and printing a plurality of test lines which are offset by a multiple m, where m is an integer, of a test interval with respect to the reference interval using other head chips, and determining one of the plurality of test lines that matches any of the plurality of reference lines of each of the head chips, and determining an amount of offset of the determined test line as an amount of offset of each head chip.

The determining of the amount of offset of each head chip may include determining an amount of offset of a matching test line of a plurality of test lines of a preceding head chip closer to the reference head chip than a corresponding head chip and a plurality of test lines of a corresponding head chip as a relative offset amount of the corresponding head chip with respect to the preceding head chip, and determining a sum of the offset amount of the preceding head chip with respect to the reference head chip and the relative offset amount of the corresponding head chip with respect to the preceding head chip as an amount of offset of the corresponding head chip with respect to the reference head chip.

Assuming the resolution of the array inkjet head is R and a positive integer is n, the test interval may be represented as R/n.

The method may further include storing the offset amount in a memory of the array inkjet head as offset data.

Example embodiments of the present general inventive concept can also provide a method of correcting an offset of an inkjet head having a plurality of head chips, the method including selecting a reference head chip from among the plurality of head chips, printing a plurality of reference lines spaced apart from one another at a reference interval in a sub-scanning direction using the reference head chip, printing a plurality of test lines spaced apart from each other in the sub-scanning direction by a predetermined multiple of the reference interval using the other head chips, and determining an amount of offset of each of the other head chips relative to the reference head chip based on an amount of offset between the test lines and the reference lines.

The method may further include selecting one of the test lines which most closely matches a reference line of the reference head chip in the sub-scanning direction with respect to each of the other head chips, and determining the amount of offset of each of the other head chips relative to the reference head chip based on the reference interval of the matching reference line and the predetermined multiple of the matching test line with respect to each of the other head chips.

The method may further include selecting one of the test lines of a first other head chip which most closely matches a reference line of the reference head chip in the sub-scanning direction, determining the amount of offset of the first other head chip relative to the reference head chip by comparing the predetermined multiple of the selected test line with the reference interval of the matching reference line, and determining the amount of offset of the remaining other head chips based on an amount of offset between the test lines of the remaining other head chips and the selected test line.

The head chips may be arranged in at least one row along a main scanning direction, and a length of the at least one row may be greater than a width of the print media to be printed.

The method may further include scanning the test lines and the reference lines to determine the offset therebetween.

Example embodiments of the present general inventive concept can also provide an inkjet head to print ink on a printing medium, the inkjet head including a plurality of head chips including a reference head chip, and a controller to control the plurality of head chips to print a plurality of reference lines spaced apart from one another at a reference interval in a sub-scanning direction using the reference head chip, to print a plurality of test lines spaced apart from each other in the sub-scanning direction by a predetermined multiple of the reference interval using the other head chips, and to determine an amount of offset of each of the other head chips relative to the reference head chip based on an amount of offset between the test lines and the reference lines.

The controller can select one of the test lines which most closely matches a reference line of the reference head chip in the sub-scanning direction with respect to each of the other head chips, and can determine the amount of offset of each of the other head chips relative to the reference head chip based on the reference interval of the matching reference line and the predetermined multiple of the matching test line with respect to each of the other head chips.

The controller can select one of the test lines of a first other head chip which most closely matches a reference line of the reference head chip in the sub-scanning direction, can determine the amount of offset of the first other head chip relative to the reference head chip by comparing the predetermined multiple of the selected test line with the reference interval of the matching reference line, and can determine the amount of offset of the remaining other head chips based on an amount of offset between the test lines of the remaining other head chips and the selected test line.

The inkjet head can further include an optical reader to read the test lines and the reference lines.

Example embodiments of the present general inventive concept can also provide a computer readable medium having computer readable codes embodied thereon to execute a method of correcting an offset of an inkjet head having a plurality of head chips, the method including selecting a reference head chip from among the plurality of head chips, printing a plurality of reference lines spaced apart from one another at a reference interval in a sub-scanning direction using the reference head chip, printing a plurality of test lines spaced apart from each other in the sub-scanning direction by a predetermined multiple of the reference interval using the other head chips, and determining an amount of offset of each of the other head chips relative to the reference head chip based on an amount of offset between the test lines and the reference lines.

BRIEF DESCRIPTION OF THE DRAWINGS

These and/or other example embodiments of the present general inventive concept will become apparent and more readily appreciated from the following description of the embodiments, taken in conjunction with the accompanying drawings of which.

DETAILED DESCRIPTION OF THE EMBODIMENTS

Figure 1:
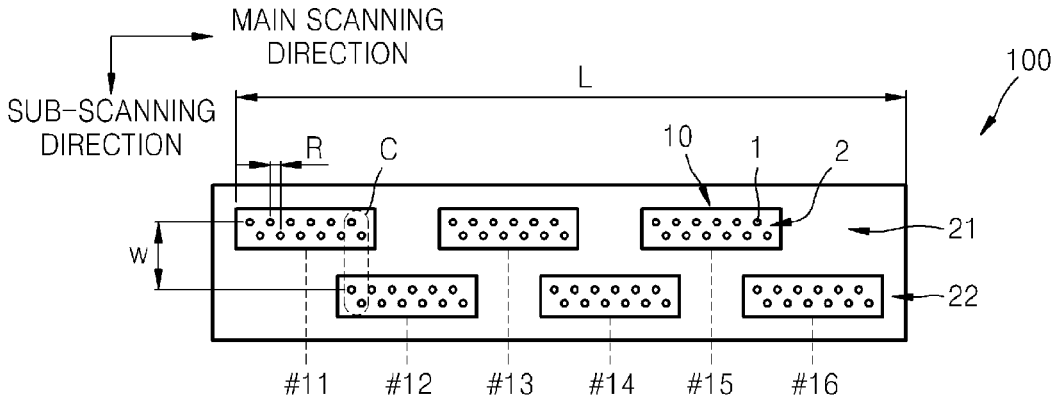
FIG. 1 is a plan view of an array inkjet printhead illustrating a method of correcting an alignment error according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a plan view of an array inkjet printhead 100 using a method of correcting an alignment error according to an embodiment of the present general inventive concept. Referring to FIG. 1, the array inkjet printhead 100 can be embodied by arranging a plurality of head chips 10 in a main scanning direction. The overall length L of the head chips 10 in the main scanning direction can be greater than the width of the paper to be printed.

The head chip 10 can have a structure capable of ejecting ink supplied from an ink tank (not illustrated) through a nozzle 1 by applying pressure to the ink using a predetermined ejection unit (not illustrated). The ejection unit may be a heater (not illustrated) to eject ink by applying heat to the ink in an ink chamber (not illustrated) to generate air bubbles, although the present general inventive concept is not limited thereto. For example, it is possible that the ejection unit may be a piezoelectric body (not illustrated). In such case, the ink may be ejected through the nozzle 1 due to a change in the volume of the ink in the ink chamber which can be generated by the deformation of the piezoelectric material. Since the principle of ejecting ink of a head chip is well known in the field to which the present general inventive concept pertains, a detailed description thereof will be omitted herein to prevent the general inventive concept from being obscured in unnecessary detail.

Figure 5:
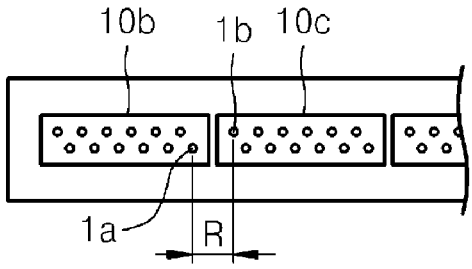
FIG. 5 is a partial plan view of an array inkjet printhead and a head chip arrangement according to another embodiment of the present general inventive concept.

Referring to FIG. 5, the head chips 10 may be arranged linearly in a main scanning direction. In this case, a last nozzle 1*a* of a leading head chip 10*b* and a first nozzle 1*b* of a next head chip 10*c* can be arranged accurately at an interval of resolution R in the main scanning direction. However, when the head chips 10 are arranged in the main scanning direction in a row, it can be very difficult to satisfy this condition.

Thus, as illustrated in FIG. 1, the head chips 10 can be arranged in two head chip rows 21 and 22 separated from each other in a sub-scanning direction that is perpendicular to the main scanning direction. Here, the head chips 10 in the head chip rows 21 and 22 can be arranged zigzag, which is to say that the last nozzle of a leading head chip and the first nozzle of a next head chip may be arranged accurately at an interval of resolution R in the main scanning direction. There may be a print characteristic between the head chips 10, for example, a slight difference in the size of an ink drop that is ejected. To reduce a difference in images printed by the head chips 10, the head chips 10 may be arranged such that the nozzles of the adjacent head chips may be partially overlapped with one another as indicated by a dotted line C of FIG. 1. Although FIG. 1 illustrates the array inkjet printhead 100 having two head chip rows 21 and 22, the present general inventive concept is not limited thereto. For example, it is possible that three or more head chip rows may be provided without departing from the broader principles and spirit of the present general inventive concept.

Referring again to FIG. 1, each of the head chips 10 can include a nozzle row 2 and a plurality of nozzles 1 can be arranged zigzag in the nozzle row 2. The interval between the nozzles that are most adjacent in the main scanning direction represents the resolution R.

Figure 2:
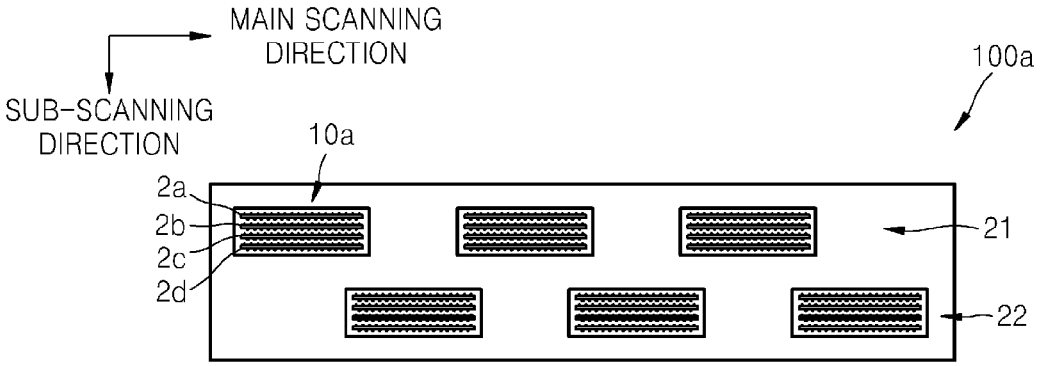
FIG. 2 is a plan view of an array inkjet printhead capable of color printing, as an example of an array inkjet printhead illustrating a method of correcting an alignment error according to an embodiment of the present general inventive concept.

As illustrated in FIG. 2, in an array inkjet printhead 100*a* to print a color image, four nozzles rows 2*a*, 2*b*, 2*c*, and 2*d* may be provided in a head chip 10*a*. In this case, for example, the nozzles rows 2*a*, 2*b*, 2*c*, and 2*d* may respectively eject ink of black (K), yellow (Y), magenta (M), and cyan (C) colors.

Figure 3:
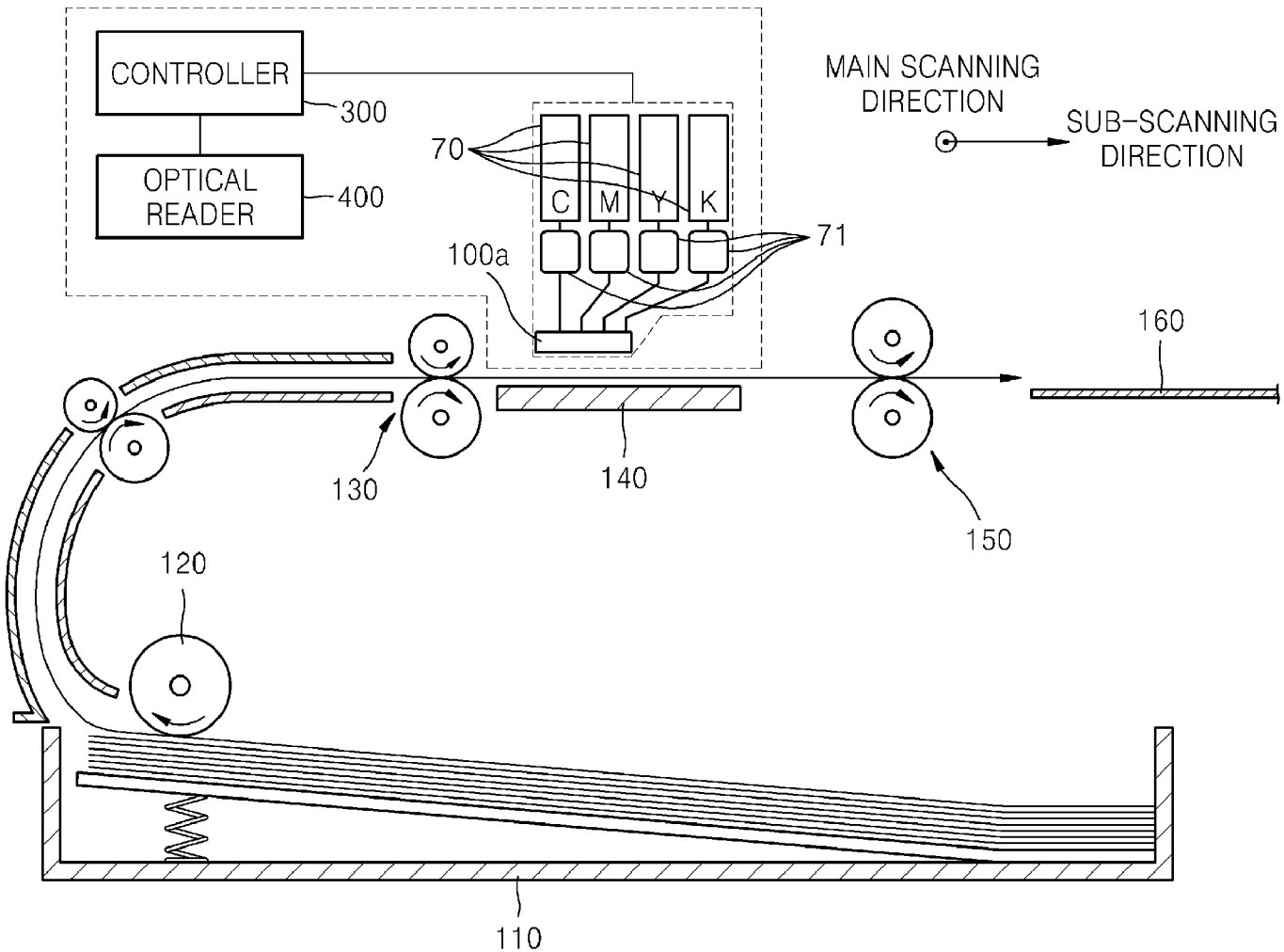
FIG. 3 illustrates the structure of an inkjet image forming apparatus using an array inkjet printhead.

FIG. 3 illustrates the structure of an inkjet image forming apparatus using the array inkjet printhead 100*a* of FIG. 2. Referring to FIG. 3, four ink tanks 70K, 70Y, 70M, and 70C respectively containing ink of black (K), yellow (Y), magenta (M), and cyan (C) colors can be connected to four nozzle rows 2*a*, 2*b*, 2*c*, and 2*d* of the head chip 10*a* to form the array inkjet printhead 100*a*. Negative pressure regulators 71K, 71Y, 71M, and 71C may be interposed between the ink tanks 70K, 70Y, 70M, and 70C and the array inkjet printhead 100*a* to adjust the negative pressure of ink and prevent the intrusion of air bubbles into the array inkjet printhead 100*a* and unnecessary leakage of ink by maintaining meniscus of the nozzle 1. The inkjet image forming apparatus can include a controller 300 to control the array inkjet printhead 100*a* to print ink to a printing medium, such as paper, and an optical reading apparatus 400, such as a scanner, to read the images printed on the printed medium.

The paper drawn from a paper feeding cassette 110 by a pickup roller 120 can be transferred in the sub-scanning direction by a transfer roller 130. The paper can maintain a predetermined interval, for example, 0.5-2.0 mm, from the head chip 10*a* of the array inkjet printhead 100*a* by a platen 140. The array inkjet printhead 100*a* at a fixed position can print an image on the paper by ejecting ink. After printing, the paper can be exhausted to a paper stacking plate 160 by an exhaust roller 150.

Referring to FIG. 1, when the head chips 10 are arranged in rows 21 and 22, the interval W between the head chip rows 21 and 22 in the sub-scanning direction remains constant. Also, the head chips 10 in each of the head chip rows 21 and 22 are aligned without an offset in the sub-scanning direction. When these conditions are met, an image printed by the head chip row 21 and an image printed by the head chip row 22 may be accurately matched to each other. However, it is costly to perform a fine adjustment in the manufacturing process of the array inkjet printhead to maintain such alignment during the manufacturing process. Thus, in accordance with the present general inventive concept it is possible to reduce the manufacturing costs and improve productivity by providing a system and method of correcting an alignment error of the head chips 10 in order to maintain high print quality of the printed image while at the same time lowering the manufacturing tolerances and alignment accuracy of the head chips 10 to reduce manufacturing costs.

Figure 4:
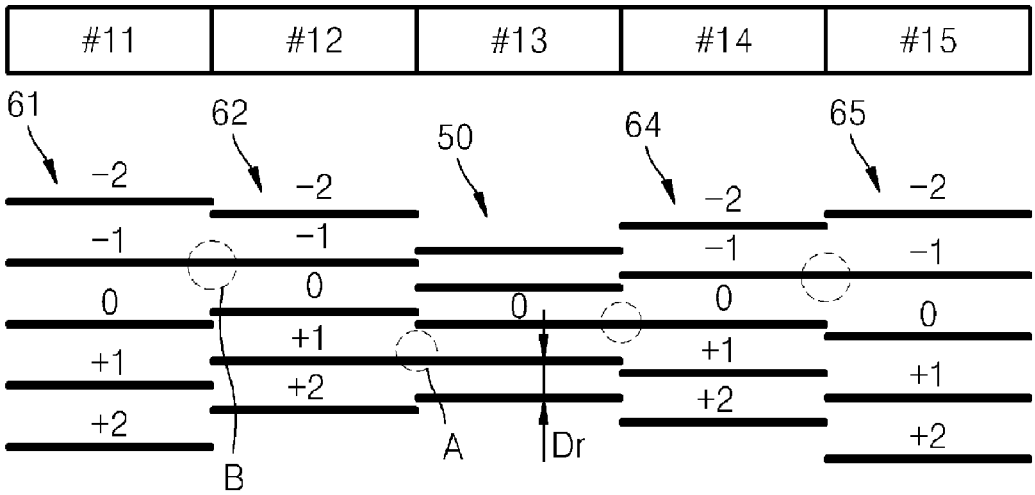
FIG. 4 illustrates a method of correcting an alignment error according to an embodiment of the present general inventive concept.

FIG. 4 illustrates a method of correcting an alignment error according to an embodiment of the present general inventive concept. Referring to FIGS. 1 and 4, a method of correcting an alignment error according to an embodiment of the present general inventive concept is described below.

Referring to FIGS. 1 and 4, any one of a plurality of head chips 11-16 can be selected as a reference head chip. In the present example embodiment, the head chip 13 located at the center of the head chips 11-16 is selected as a reference head chip, although it is possible that any head chip may be selected as the reference head chip without departing from the present general inventive concept.

Next, a plurality of reference lines 50 separated from one another at a reference interval Dr in the sub-scanning direction can be printed using the reference head chip 13. Here, the reference interval Dr is not limited to any particular value, and it is possible that any interval may be set, for example, to a value where the reference lines 50 can be identified with the naked eye.

As the reference lines 50 are printed, the other head chips 11, 12, 14, and 15 can simultaneously print a plurality of test lines 61, 62, 64, and 65, respectively. Here, the test lines 61, 62, 64, and 65 can be printed by being offset by an integer multiple m of a test interval Dt with respect to the reference interval Dr in the sub-scanning direction. That is, as illustrated in FIG. 4, five test lines 62 can be printed by being offset as much as −2 Dt, −1 Dt, −0 Dt, 1 Dt, and 2 Dt with respect to the reference interval Dr. In FIG. 4, the numbers "−2, −1, 0, +1, and +2" respectively denote offsets of −2 Dt, −1 Dt, −0 Dt, 1 Dt, and 2 Dt.

The test interval Dt may be, for example, a value obtained by dividing the resolution R of the array inkjet printhead 100 by a positive integer n. For example, when the array inkjet printhead 100 is capable of printing at 1200 dpi (dot per inch), the resolution R is about 21.5 μm. In this case, when the positive integer n is 2, the test interval Dt can be an integer multiple of about 10 μm and an alignment error may be corrected at an interval of about 10 μm. As the positive integer n increases, an interval to correct an alignment error decreases so that the alignment error may be corrected more accurately.

According to an example embodiment of the present general inventive concept, one of the test lines 62 of the head chip 12 that matches one of the reference lines 50 can be sought for. This process may be carried out using the naked eye. Also, the matching test line may be sought for by reading the test lines 62 and the reference lines 50 using an optical reading apparatus 400 (FIG. 3) such as an image scanner. In FIG. 4, for example, the test line 62 printed by being offset by +1 Dt as indicated by a circle A can be determined to match the reference line. Thus, the amount of the offset in the sub-scanning direction with respect to the reference head chip 13 of the head chip 12 can be determined to be +1 Dt. This means that the head chip 12 can be arranged by being offset by +1 Dt in the sub-scanning direction with respect to the reference head chip 13 in a manufacturing process. Accordingly, by delaying the ink ejection timing of the head chip 12 by 1 Dt during printing, printing without an offset from the reference head chip 13 may be possible, even though an alignment error occurs during manufacturing of the head chip. The amount of offsets of the other head chips 11, 14, 15, and 16 may be determined in a similar manner.

It is also possible that the determined amounts of offsets of head chips may be stored in a memory (not illustrated), for example, customer replaceable unit monitor (CRUM), of the array inkjet print head 100 as offset data. For example, in an inkjet image forming apparatus having the array inkjet printhead 100, printing with a corrected alignment error may be performed by controlling the ink ejection timing of each of the head chips 10 by using the stored offset data. Alternatively, the offset data may be stored in a memory (not illustrated) of an inkjet image forming apparatus having the array inkjet printhead 100.

As described above, the alignment error in the sub-scanning direction of the head chips generated in the manufacturing process may be corrected by the alignment error correction method according to an example embodiment of the present general inventive concept. When the alignment error correction method is used, the accuracy in the alignment of the head chips 10 may be reduced in the manufacturing process of the inkjet printhead 100. Thus, the manufacturing costs and print defects due to the alignment error of the head chips may be reduced so that superior print quality may be obtained.

In accordance with another example embodiment of the present general inventive concept, it is possible that the amount of offset of each head chip may be obtained as follows. For example, when the amount of offset of the head chip 11 is determined, after determining the amount of offset of the head chip 12 located closer to the reference head chip 13 and preceding the head chip 11, as described above, a relative offset amount of the head chip 11 with respect to the preceding head chip 12 can be obtained. In this case, the sum of the relative offset amount of the head chip 11 with respect to the preceding head chip 12 and the offset amount of the preceding head chip 12 with respect to the reference head chip 13 can be an amount of offset of the head chip 11 with respect to the reference head chip 13. For example, it is possible to determine that the amount of offset of the preceding head chip 12 with respect to the reference head chip 13 is +1 Dt. Next, one of the test lines 61 of the head chip 11 that matches any of the test lines 62 of the head chip 12 can be sought for. As illustrated in FIG. 4, one of the test lines 61 of the head chip 11 that is offset by −1 Dt can be determined to match one of the test lines 62 of the preceding head chip 12, as indicated by a circle B. In this case, the relative offset amount of the head chip 11 to the preceding head chip 12 can be determined to be −Dt. The offset amount of the head chip 11 relative to the reference head chip 13 can thus be determined to be 0 (+1 Dt+(−Dt)=0). The same process may be applied to the other head chips 14, 15, and 16.

The present general inventive concept can also be embodied as computer-readable codes on a computer-readable medium. The computer-readable medium can include a computer-readable recording medium and a computer-readable transmission medium. The computer-readable recording medium is any data storage device that can store data which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A method of correcting an alignment error of an array inkjet heading having a plurality of head chips to print a main scanning line, the method comprising: determining a reference head chip; printing a plurality of reference lines in the main scanning direction to be separated from one another at a reference interval in a sub-scanning direction using the reference head chip, and printing a plurality of test lines which are offset by a multiple m, where m is an integer, of a test interval with respect to the reference interval using other head chips; and determining one of the plurality of test lines that matches any of the plurality of reference lines with respect to each of the head chips, and determining an amount of offset of the determined test line of each head chip as an amount of offset of each head chip; wherein the determining of the amount of offset of each head chip comprises: determining an amount of offset of a matching test line of a plurality of test lines of a preceding head chip closer to the reference head chip than a corresponding head chip and a plurality of test lines of a corresponding head chip as relative offset amount of the corresponding head chip with respect to the preceding head chip; and determining a sum of the offset amount of the preceding head chip with respect to the reference head chip and the relative offset amount of the corresponding head chip with respect to the preceding head chip as an amount of the offset of the corresponding head chip with respect to the reference head chip.

2. The method of claim 1, wherein, assuming that resolution of the array inkjet head is R and a positive integer is n, the test interval is R/n.

3. The method of claim 1, further comprising storing the offset amount in a memory of the array inkjet head as offset data.

4. A method of correcting an offset of an inkjet head having a plurality of head chips, the method comprising: selecting a reference head chip from among the plurality of head chips; printing a plurality of reference lines space apart from one another at a reference interval in a sub-scanning direction using the reference head chip; printing a plurality of test lines space apart from each other in the sub-scanning direction by a predetermined multiple of the reference interval using the other head chips; and determining an amount of offset of each of the other head chips relative to the reference head chips based on an amount of offset between the test lines and the reference lines, wherein the determining of the amount of offset of each of the other head chip comprises: determining an amount of offset of a matching test line of a plurality of test lines of a preceding head chip closer to the reference head chip than a corresponding head chip and a plurality of test lines of a corresponding head chip as relative offset amount of the corresponding head chip with respect to the preceding head chip; and determining a sum of the offset amount of the preceding head chip with respect to the reference head chip and the relative offset amount of the corresponding head chip with respect to the preceding head chip as an amount of the offset of the corresponding head chip with respect to the reference head chip.

5. The method of claim 4, further comprising:

selecting one of the test lines which most closely matches a reference line of the reference head chip in the sub-scanning direction with respect to each of the other head chips; and determining the amount of offset of each of the other head chips relative to the reference head chip based on the reference interval of the matching reference line and the predetermined multiple of the matching test line with respect to each of the other head chips.

6. The method of claim 4, further comprising:

selecting one of the test lines of a first other head chip which most closely matches a reference line of the reference head chip in the sub-scanning direction;

determining the amount of offset of the first other head chip relative to the reference head chip by comparing the predetermined multiple of the selected test line with the reference interval of the matching reference line; and determining the amount of offset of the remaining other head chips based on an amount of offset between the test lines of the remaining other head chips and the selected test line.

7. The method of claim 4, wherein the head chips are arranged in at least one row along a main scanning direction, and a length of the at least one row is greater than a width of the print media to be printed.

8. The method of claim 4, further comprising:

scanning the test lines and the reference lines to determine the offset therebetween.

9. An inkjet head to print ink on a printing medium, the inkjet head comprising: a plurality of head chips including a reference head chip; and a controller to control the plurality of head chips to print a plurality of reference lines space apart from one another at a reference interval in a sub-scanning direction using the reference head chip to print a plurality of test lines space apart from each other in the sub-scanning direction by a predetermine multiple of the reference interval using the other head chips, and to determine an amount of offset of each of the other head chips relative to the reference head chip base on an amount of offset between the test lines and the reference lines; and wherein the determining of the amount of offset of each of the other head chip comprises: determining an amount of offset of a matching test line of a plurality of test lines of a preceding head chip closer to the reference head chip than a corresponding head chip and a plurality of test lines of a corresponding head chip as relative offset amount of the corresponding head chip with respect to the preceding head chip; and determining a sum of the offset amount of the preceding head chip with respect to the reference head chip and the relative offset amount of the corresponding head chip with respect to the preceding head chip as an amount of the offset of the corresponding head chip with respect to the reference head chip.

10. The inkjet head of claim 9, wherein the controller selects one of the test lines which most closely matches a reference line of the reference head chip in the sub-scanning direction with respect to each of the other head chips, and determines the amount of offset of each of the other head chips relative to the reference head chip based on the reference interval of the matching reference line and the predetermined multiple of the matching test line with respect to each of the other head chips.

11. The inkjet head of claim 9, wherein the controller selects one of the test lines of a first other head chip which most closely matches a reference line of the reference head chip in the sub-scanning direction, determines the amount of offset of the first other head chip relative to the reference head chip by comparing the predetermined multiple of the selected test line with the reference interval of the matching reference line, and determines the amount of offset of the remaining other head chips based on an amount of offset between the test lines of the remaining other head chips and the selected test line.

12. The inkjet head of claim 9, wherein the head chips are arranged in at least one row along a main scanning direction, and a length of the at least one row is greater than a width of the print medium.

13. The inkjet head of claim 9, further comprising:

an optical reader to read the test lines and the reference lines.

* * * * *